US009863622B1

(12) United States Patent
Armer et al.

(10) Patent No.: US 9,863,622 B1
(45) Date of Patent: Jan. 9, 2018

(54) UNDERWATER LIGHTS FOR DIVERS

(71) Applicant: Light & Motion Industries, Marina, CA (US)

(72) Inventors: Jarod Armer, Aromas, CA (US); Christopher McCaslin, Alameda, CA (US); Beau Jesse Robertson, Santa Cruz, CA (US); Theodore Dale Masek, Monterey, CA (US); Brooks Lame, Seaside, CA (US)

(73) Assignee: Light & Motion Industries, Marina, CA (US)

( * ) Notice: Subject to any disclaimer, the term of this patent is extended or adjusted under 35 U.S.C. 154(b) by 262 days.

(21) Appl. No.: 14/548,213

(22) Filed: Nov. 19, 2014

Related U.S. Application Data

(63) Continuation-in-part of application No. 12/927,608, filed on Nov. 17, 2010, now Pat. No. 9,188,292.

(51) Int. Cl.

| | |
|---|---|
| ***F21V 23/04*** | (2006.01) |
| ***F21V 7/00*** | (2006.01) |
| ***F21L 4/08*** | (2006.01) |
| ***F21V 23/00*** | (2015.01) |
| ***F21V 7/04*** | (2006.01) |
| ***F21V 31/00*** | (2006.01) |

(Continued)

(52) U.S. Cl.
CPC ..... *F21V 23/0414* (2013.01); *F21L 4/08* (2013.01); *F21V 7/0091* (2013.01); *F21V 7/041* (2013.01); *F21V 23/005* (2013.01); *F21V 23/023* (2013.01); *F21V 31/005* (2013.01); *F21W 2131/40* (2013.01); *F21Y 2101/025* (2013.01); *F21Y 2105/001* (2013.01)

(58) Field of Classification Search
CPC .... F21V 23/0414; F21V 7/041; F21V 31/005; F21L 4/08
See application file for complete search history.

(56) References Cited

U.S. PATENT DOCUMENTS 2,654,795 A * 10/1953 Solomon ..... H01M 4/34 419/35
3,792,389 A 2/1974 Murphy
(Continued)

FOREIGN PATENT DOCUMENTS

| | | | |
|---|---|---|---|
| GB | 16257 A * | 0/1913 | ..... F21V 33/00 |
| JP | 2003-178602 | 6/2003 | |
| WO | WO2012067657 | 5/2012 | |

*Primary Examiner* — Sharon Payne
(74) *Attorney, Agent, or Firm* — Thomas M. Freiburger

(57) ABSTRACT

An LED underwater light, which can be hand-held or mounted on an underwater camera housing, is switchable between two light modes. A first embodiment of the dive light is a focus light, used for initial focusing with a still underwater camera. Incorporated in the focus light is a red light source to which the focus light can be switched from initially projected white light. The switch is used to switch off a series of white LEDs while switching on a series of red LEDs. In another embodiment, the dive light is a flood/spot light, or with another two types of selectable LED arrays, and enables a diver to quickly switch between two types of light projection. Another feature is a laser beam projecting device within the housing, with a momentary switch on the housing to power the laser, as for pointing out underwater objects of interest, the laser beam being projected to the same area as the spot beam.

20 Claims, 11 Drawing Sheets

(51) Int. Cl.

| | |
|---|---|
| ***F21V 23/02*** | (2006.01) |
| *F21Y 105/00* | (2016.01) |
| *F21W 131/40* | (2006.01) |
| *F21Y 101/02* | (2006.01) |

(56) References Cited

U.S. PATENT DOCUMENTS

| | | | | |
|---|---|---|---|---|
| 3,794,825 | A | 2/1974 | Krupansky | |
| 6,120,164 | A * | 9/2000 | Libin | F21V 21/30 362/227 |
| 6,483,651 | B1 | 11/2002 | Maurer | |
| 6,808,287 | B2 | 10/2004 | Lebens et al. | |
| 6,909,250 | B2 | 6/2005 | Jigamian et al. | |
| 7,199,316 | B2 | 4/2007 | Gorrie et al. | |
| 7,303,303 | B1 | 12/2007 | Haynes et al. | |
| 7,509,043 | B2 | 3/2009 | Matsui et al. | |
| 7,756,413 | B2 | 7/2010 | Matsui et al. | |
| 7,771,077 | B2 | 8/2010 | Miller | |
| 8,384,275 | B2 | 2/2013 | Tanaka et al. | |
| 9,018,828 | B2 | 4/2015 | Tanaka et al. | |
| 9,115,876 | B1 * | 8/2015 | Mart | F21V 23/005 |
| 2002/0001463 | A1 | 1/2002 | Inoue et al. | |
| 2003/0095408 | A1 | 5/2003 | Opolka | |
| 2003/0169178 | A1 * | 9/2003 | Jensen | F21S 9/02 340/815.5 |
| 2005/0002186 | A1 | 1/2005 | Krieger et al. | |
| 2005/0036306 | A1 | 2/2005 | Hsien | |
| 2005/0281020 | A1 | 12/2005 | Liaw et al. | |
| 2006/0077657 | A1 | 4/2006 | Vickers et al. | |
| 2006/0274520 | A1 | 12/2006 | Dalton et al. | |
| 2007/0115387 | A1 | 5/2007 | Ho | |
| 2007/0279900 | A1 | 12/2007 | Bauer et al. | |
| 2009/0014624 | A1 | 1/2009 | Blees et al. | |
| 2009/0059598 | A1 * | 3/2009 | Pruss | F21V 5/04 362/296.05 |
| 2009/0116231 | A1 | 5/2009 | Miller | |
| 2009/0189541 | A1 | 7/2009 | Crawford et al. | |
| 2010/0124050 | A1 * | 5/2010 | Hau | F21S 6/001 362/183 |
| 2011/0058360 | A1 * | 3/2011 | Taiga | F21L 4/02 362/158 |
| 2012/0176780 | A1 * | 7/2012 | Gross | F21L 4/027 362/184 |

* cited by examiner

UNDERWATER LIGHTS FOR DIVERS

This application is a continuation-in-part of application Ser. No. 12/927,608, filed Nov. 17, 2010, now U.S. Pat. No. 9,188,292.

BACKGROUND OF THE INVENTION

This invention concerns underwater lighting, including for photography, and in particular a compact and powerful underwater light that is easily switched from one mode to another. In one aspect the device is a focus light or imaging light for underwater diving, used to locate photography subjects in darkness or very low light situations. The device of the invention allows focusing on a subject using a camera's auto focusing feature, then moving in on a subject without disturbing the subject. In another aspect the device is a flood light that toggles to a spot light, switching modes in the same way as the imaging light. The device may also include a laser pointer.

Focusing lights for underwater diving are well known. Used in low light situations such as night diving, the focusing light, typically mounted on an underwater camera housing, is used to locate and then focus on a subject for photography, taking advantage of the auto focus feature on a still camera.

An imaging light can also be used for taking video of underwater subjects. When used as a video light the typical arrangement is with two lights separated at some distance, both focused on the subject. When used as a focus light, the typical arrangement is mounted on the top of the photo housing where the user has quick access and the light points in the same direction of the camera. In photography applications the actual photo is taken using powerful strobes. The focus light insures the camera is properly focused prior to the actual shot when the strobes fire in concert with the camera shutter. The strobes overpower the focus light, which doesn't interfere with the shot even if left on.

A problem is that the white light of the focus light tends to cause fish or other animal subjects to react, quickly escaping before being captured in a photograph. The diver is thus unable to move in on the subject with the light before taking the picture.

It is known that red light generally does not have the same effect on the seagoing creatures, who often do not see or react to red light due to the filtering effect of the water which over 30 feet in depth typically filters out most red and yellow wavelengths. Consequently the fish or other animals do not react to red light. For this reason, one solution previously provided on focus lights has been a red flip-down filter that can be brought down over the front lens or window of the white light.

Red light has the additional advantage that it tends to attract fewer small creatures that are often attracted to white light and tend to swarm around white lights, interfering with the shot. This causes the photographer to turn lights off completely and wait until the swarming creatures, often the size of small flies or gnats, leave the area before turning the lights back on just before taking the shot.

Dive lights are often used by divers for viewing scenes and objects, whether or not in support of underwater photography. To illuminate a large scene a diver will need a flood light, while looking deep into a cave, or signaling a companion, usually requires a spot beam. Until this invention there has been no compact, high-power unitary device that is quickly toggled between flood beam and spot beam.

A further desire of divers is to be able to point out specific objects to other divers with a high degree of accuracy, such as identifying a small animal of interest. Recently, divers have begun using green lasers for this purpose; green lasers perform much better than common red lasers because they are much brighter to start with, and red light is rapidly absorbed as it travels through seawater. However, no lighting devices currently known provide the user the ability to illuminate a scene with spot or flood light, and switch to a laser pointer with the same device, or vice versa. Also, no device exists in which the white spot beam is combined with a laser pointer positioned in the center (or approximately at center) of the white spot beam. Even a tight spot beam below 10° in angle casts a wide enough spot at a distance that as a pointer it lacks the precision of a laser which can produce a point of light on a distant subject.

There is a need for a more efficient, compact, convenient, and high-powered underwater lighting device for conveniently switching between one form of light projection to another, while also preferably allowing for adjustment of light level, along with other desirable features.

SUMMARY OF THE INVENTION

The invention addresses these needs by providing an LED underwater light, which can be hand-held or mounted on an underwater camera housing, and which in one embodiment is for use in initial focusing with a still underwater camera. As noted above, in one embodiment the device is used to provide sufficient initial white light on a subject to locate a subject and to allow focusing of the camera through its auto focus feature. Incorporated in the disclosed focus light is a red light source to which the focus light can be switched from the initially projected white light. The switch is used to switch off a series of white LEDs while switching on a series of red LEDs. In this way a diver at night can search for subjects using the white light, allowing the camera to auto focus on a subject, then switch to the red light to move in closer, so that sea animal subjects will not see or react to the red light.

In a preferred arrangement a single printed circuit board has rows or arrays of white LEDs adjacent to red LEDs. A rechargeable battery pack powers the LEDs, and a selection switch conveniently located on the light housing allows the diver to switch on the white light LEDs, adjust light level, switch to the red light LEDs, and switch the light off.

A convenient form of switch is a spring-biased switch positioned on top of the focus light casing, slidable forward or back and returning by spring to a central position. For an effective water seal, the switch preferably comprises a slide member on a switch cover, these components not being under waterproof seal but the light casing or housing being sealed below the switch mechanism. A magnetic coupling between the slide switch member and internal switch pick-ups in the sealed casing effects the switch selections.

Other features of the focus light include a reflector disc with reflector holes positioned in front of the LEDs, a screw-on front bezel with seals to the main casing, a series of light indicators at the exterior of the housing for showing light status, and a battery charging port at the exterior of the casing.

In another embodiment of the invention a very similarly constructed underwater lighting device enables convenient switching between flood light and spot light projection. Again, a single printed circuit board has two different arrays of LEDs, one with optics for flood light projection and one with optics for spot light projection. The switching is as described above. Optics are unique for the spot/flood embodiment, since both sets of LEDs are on the same board and would require very different depths of reflectors.

In another embodiment of the invention, a laser, preferably a green laser for significantly higher performance, is included in the front electronics assembly. Using similar switching to that described above, the user can rapidly switch from illumination to laser pointing and back again, or maintain illumination and add laser pointing temporarily. A separate switch may be provided for the laser.

The laser pointing beam enables a diver to point out an object of interest to a companion diver, or to communicate with other drivers by sign language using the laser beams. In clear water, locating the beam or the laser spot can be difficult; thus, the laser beam advantageously can be located within the spot beam, e.g. centrally relative to the spot beam, so that the spot beam can be turned on to find the laser spot when needed. The spot light beam can then be switched off if desired.

The invention thus provides an efficient assembly of an underwater light device that is conveniently used and is quickly switchable among modes of light. These and other objects, advantages and features of the invention will be apparent from the following description of a preferred embodiment, considered along with the accompanying drawings.

DESCRIPTION OF PREFERRED EMBODIMENTS

Figure 1:
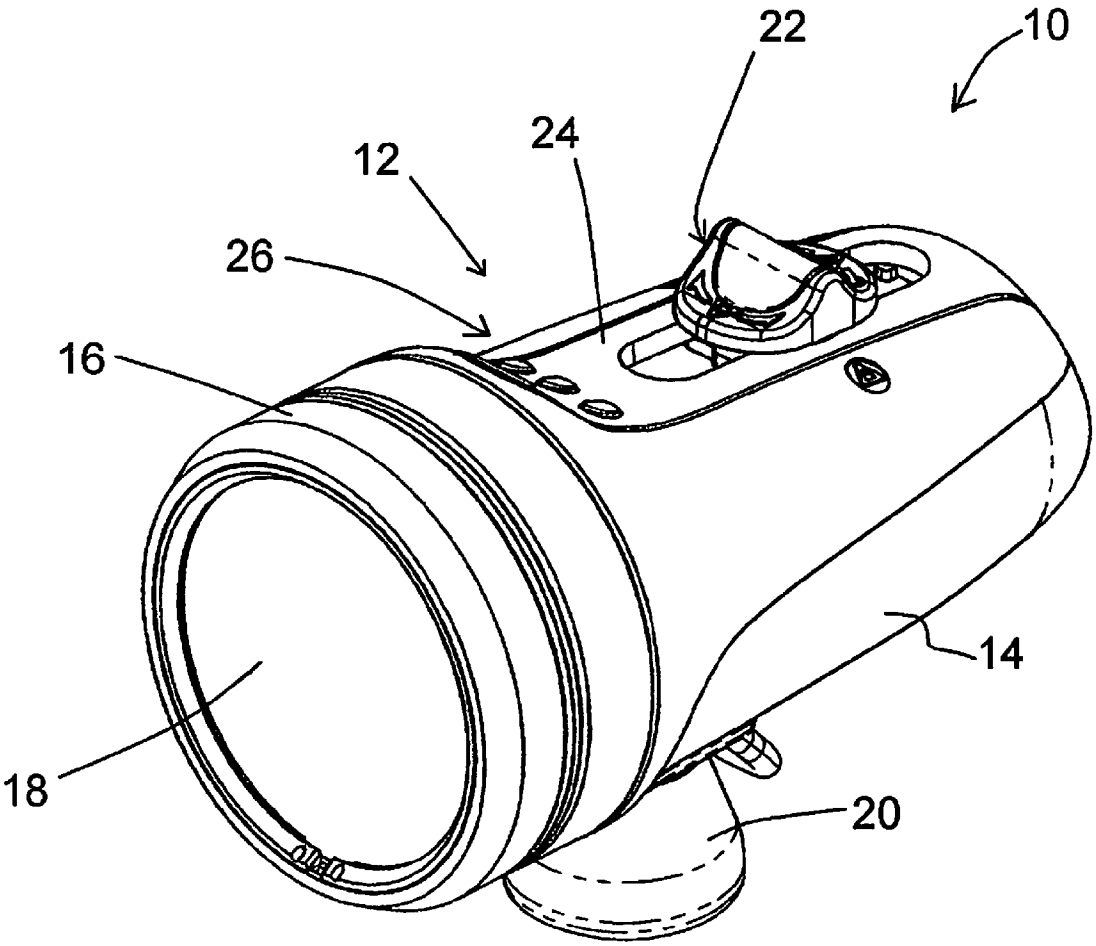
FIG. 1 is a perspective view showing the underwater light of the invention.

FIG. 1 shows an underwater photography focusing and illumination light 10 of the invention. The light device has a housing 12 including a main body or casing 14 and a front bezel 16 with a window 18 of glass, the casing, bezel and glass being sealed in watertight relationship. To the housing is attached a mounting base 20 having a fitting, not shown, for attachment to an underwater camera housing. At the base of the device is an aluminum plate that accepts a 10-32 or 1/4-20 threaded shaft commonly used in the dive industry. The imaging light can be attached in a number of methods. The most common for photography uses a ball joint with a friction clamp that allows the user to position and point the light easily. The other methods employ aluminum strobe arms or flexible plastic "Loc Line" joints that can be added to position the light farther away from the housing.

The housing also includes a slide switch 22 slidable on a slide mounting or switch cover 24. Indicator lights, preferably light pipes that conduct a light from inside the housing, are shown at 26, preferably provided to indicate light status.

Figure 2:
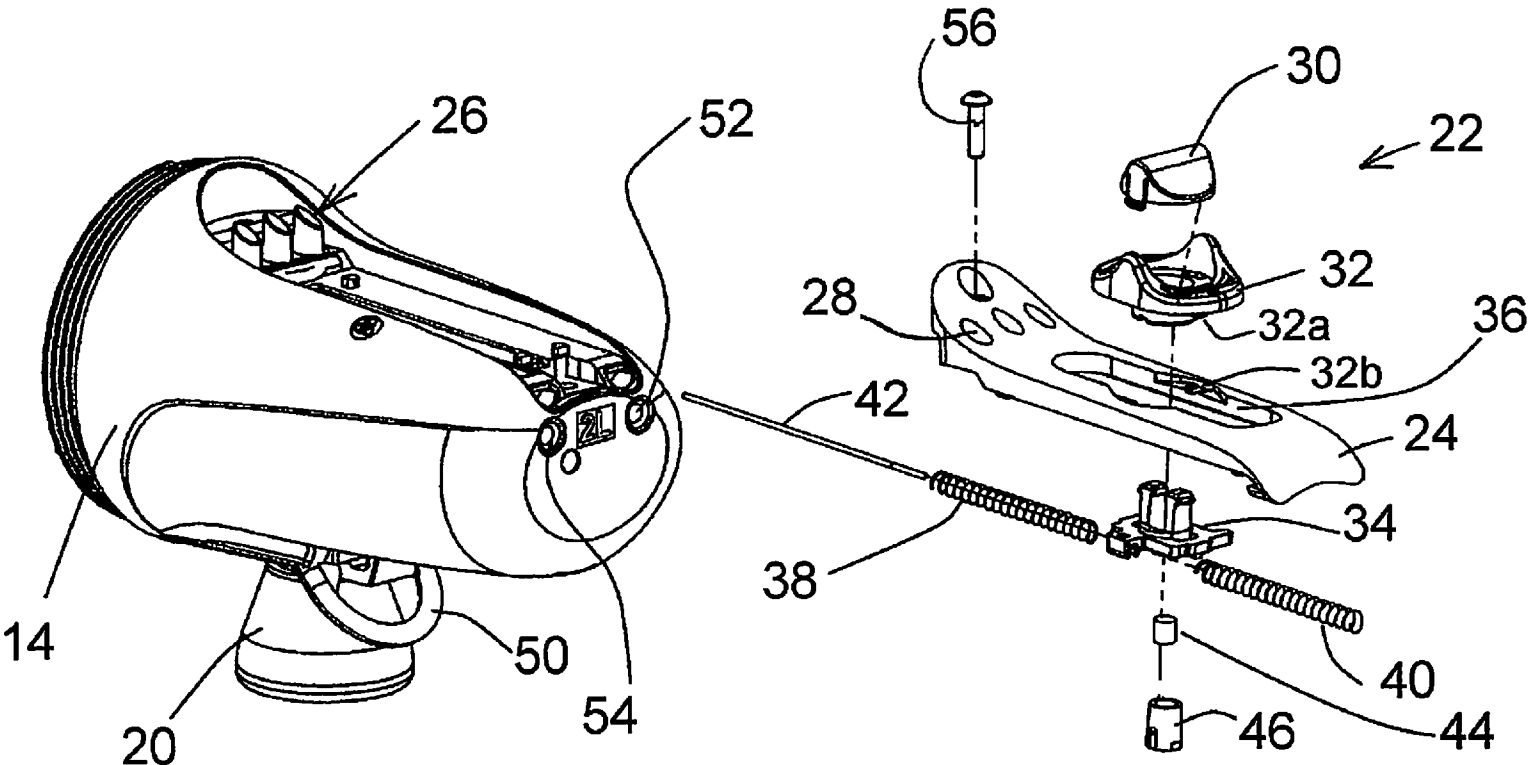
FIG. 2 is an exploded perspective view showing the housing of the light and indicating a switch assembly.

FIG. 2 shows the casing 14 without the front bezel and with the switch assembly removed. The casing or body 14 is water-sealed in the configuration shown, with the switch components being outside the water seal. As shown, the indicator light pipes 26 are positioned to extend up through holes 28 in the slide mounting or switch cover 24. The light pipes direct light from the single driver circuit board (discussed below) up to the proper viewing angle for the diver. Light pipes are typically clear acrylic, molded or extruded, straight or bent, conducting light by internal reflection.

The switch 22 includes a switch cap 30 for finger contact and a switch base 32 that receives the cap, together referred to as a switch or the slide switch 22. A shuttle member 34 of the slide switch 22 connects to the switch base 32 through a slide slot 36 of the switch cover 24, and this shuttle member is biased by compression springs 38 and 40 toward a generally central rest position within the slot 36. The springs 38 and 40 are held in line by a spring shaft 42 and are captured within the assembly when the slide mounting 24 and the other components are in place.

The slide switch 22 preferably has a locking feature to hold it in the rest position when desired, to avoid inadvertent switching on. This is not shown in detail in the drawings, but a small nipple 32*a* can be seen on the bottom side of the switch base 32 in FIG. 2, and a similar nipple can be 180°-opposed. The slide member comprised of the components 32 and 30 can be rotated 90° relative to the switch cover 24, at which point the nipples will engage in detents 32*b* provided in the switch cover. This provides a lock out feature to protect against inadvertent moving of the slide switch and turning the light on when traveling, for example. The switch can be unlocked by again turning the manual slide member (30, 32) 90° in either direction, once again allowing the switch to move forward or back when intentionally pushed.

The switch assembly 22 is not mechanically connected to switch the light color or power. This is effected by a magnetic coupling, to avoid the need for a dynamic water seal. The assembly includes a magnet 44 held within a magnet cup 46 that is secured at the bottom of the switch shuttle 34. Movement of the switch assembly including the magnet 44, by sliding the switch cap 30, is picked up by electronics within the sealed casing 14 as further discussed below.

FIG. 2 also shows a D-ring 50 preferably included adjacent to the mounting base 20, that allows the light to attach to a lanyard for non-photographic applications such as scientific dives. Also, at the rear of the casing are charging ports 52 and 54 for the battery (preferably a lithium-ion battery) contained within the casing for powering the lights. The charger has mating gold plated male plugs that insert into the exposed female charging ports and causing the internal battery to be charged. The two ports provide plus and minus connections. There is a third pin that insures the plug can only be inserted in a single orientation.

As indicated in FIG. 2, when the switch components are assembled in place, a fastener, e.g. a threaded bolt 56, secures the slide mount or switch cover 24 in place on the casing. A clip is preferably included at the rear of the switch cover to retain that end in place without a need for a fastener. Other arrangements can be used.

Figure 3:
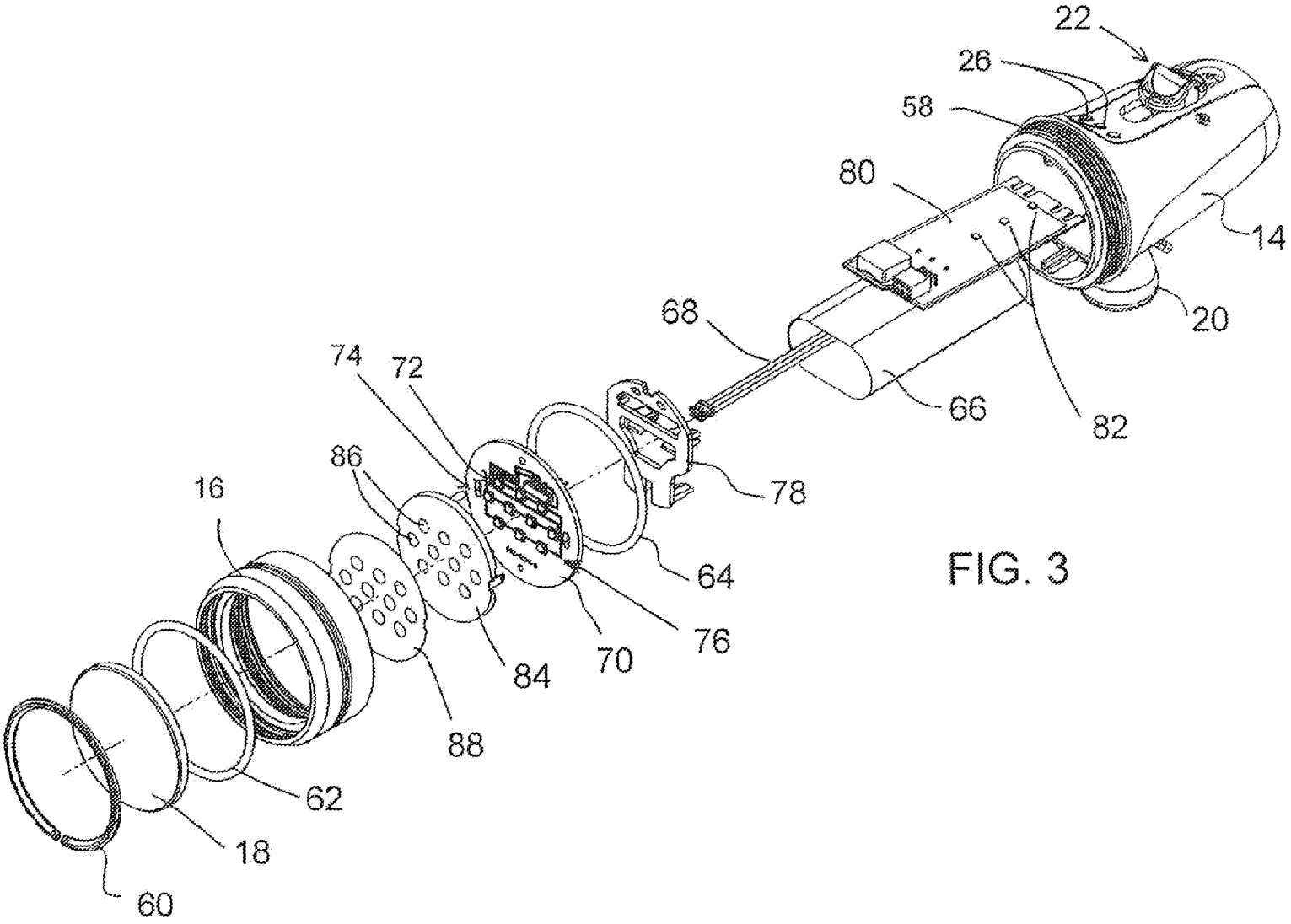
FIG. 3 is an exploded perspective view showing assembly of internal components of the focus light.

The exploded view of FIG. 3 indicates assembly of internal components into the casing 14, and closure of the housing via the bezel 16 and window 18. Threads 58 make the connection. A window retaining ring 60 is shown for holding the window within the bezel, and elastomeric O-ring seals are shown at 62 and 64.

A battery casing is shown at 66 for the rechargeable battery. A cable 68 carries power, after switching, to a printed circuit board or LED board 70 that carries rows of LEDs 72, 74 and 76. The cable 68 plugs into the back of the PCB 70. A PCB retainer is shown at 78.

An LED driver printed circuit board 80 includes switching for the LEDs. The switching is operated by magnetic pickups 82, three of which are seen in the drawing. These are sensitive to the movement of the slide switch 22 forward and back. In a preferred embodiment, sliding the switch forward momentarily initially turns power on and selects, in sequence, low, medium and high white light power settings. Momentarily moving the switch back to a rear position will switch off white light and turn on red light, which preferably has only one level but could be provided with more if desired. Holding the switch to a rear position or to the forward position will switch power off. If desired the red light could be on whenever power is on; the red LEDs draw less power, at about 200 lumens, while the white LEDs can have a high setting at about 2000 lumens with a bank of six LEDs (LEDs are improving and outputs of 3000 lumens are possible). The red light could be provided with adjustable power level if desired.

The rows of white LEDs in the illustrated assembly are at 72 and 76, top and bottom. The center row 74 is comprised of red LEDs. A reflector disc 84 immediately in front of the LED printed circuit board 70 has individual reflectors 86 positioned in front of each LED, with a desired angle of reflection provided as a conical annulus in each opening. A reflector mask is shown at 88.

Three additional small LEDs, not shown, are on the PC board 70 in position to be picked up by the light pipes 26. Preferably multi-color LEDs, these preferably indicate low, medium and high white light settings by the number of light pipes illuminated, and with different colors also indicate remaining battery charge. For example, green light from the light pipes can indicate above 75% power remaining; amber can signal 50% to 75%; red can warn of 25% to 50%; and flashing red can show a critical condition of under 25% battery remaining. This is very important in underwater night photography.

The illustrated focusing and imaging light assembly is efficient in design, is readily attached to an underwater camera casing and is very conveniently used for use of initial white focusing light, at a selected level, and for instant switching to red light for moving in on a subject. An underwater camera continues to auto focus the subject under red lighting, without startling the living photography subject.

Figure 4:
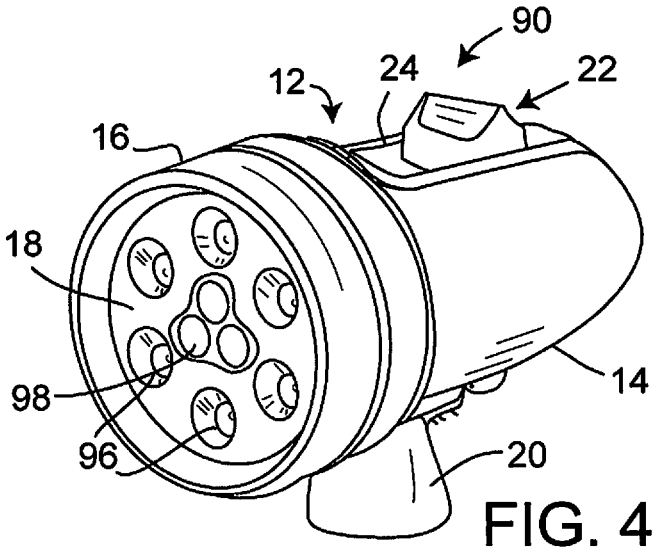
FIG. 4 is a frontal perspective view showing a second embodiment of the invention in which the underwater light device switches between flood light and spot light.
Figure 5:
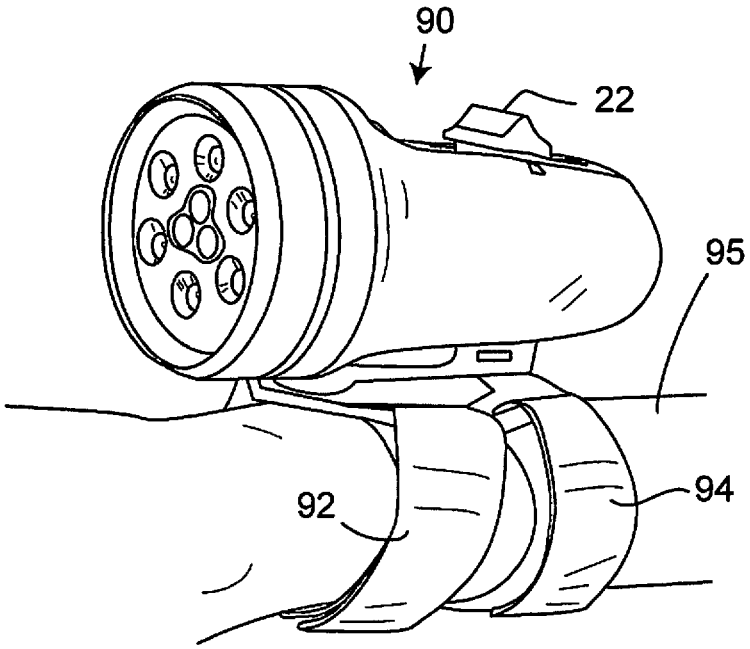
FIG. 5 is a perspective view schematically indicating a wrist strap on the dive light of this embodiment.

FIG. 4 shows in perspective a second embodiment of an underwater light 90 of the invention, with flood/spot selection. As in the above embodiment, this dive light can have a base 20 to enable mounting on another underwater device, or it can have a bracket to provide a wrist mounting. FIG. 5 shows a wrist mounting, with two straps 92 and 94 to extend around the user's wrist indicated at 95. The respective straps can engage around the wrist and palm.

The flood/spot underwater dive light 90 has exterior components similar to those of the above-described device 10: a housing 12 including a main body or casing 14 and a front bezel 16 with a window 18 preferably of glass. The casing, bezel and glass are in sealed watertight relationship. Also similar to the above embodiment, the housing assembly includes a slide switch 22 slidable on a slide mounting or switch cover 24. Indicator lights as in the first embodiment preferably included, as shown at 26 in FIG. 1.

The construction of the casing 14 and the switch assembly is similar to that shown in FIG. 2 and described above. The slide switch 22 preferably also functions in the same way as described above, although switching between different types of LED arrays.

FIG. 4 shows a ring of flood LEDs 96, which can be six in number, in an outer array within the glass window 18. At the center of the ring of flood LEDs is a tight cluster of preferably three spot LEDs 98. The slide switch 22 is used to select between flood light via the LEDs 96 and spot light via the LEDs 98, by momentarily moving the switch back to a rear position. Other control options using the slide switch 22 are the same as above: toggling the switch forward changes the power level, with level status being indicated by the light pipes 26 shown in FIG. 2. Holding the switch to a rear position or to the forward position will be effective to switch off power. Also as discussed above, the switch 22 preferably has a locking feature to hold it in the rest position when desired, to avoid inadvertent switching. The locking feature structure can be the same as described above.

Figure 6:
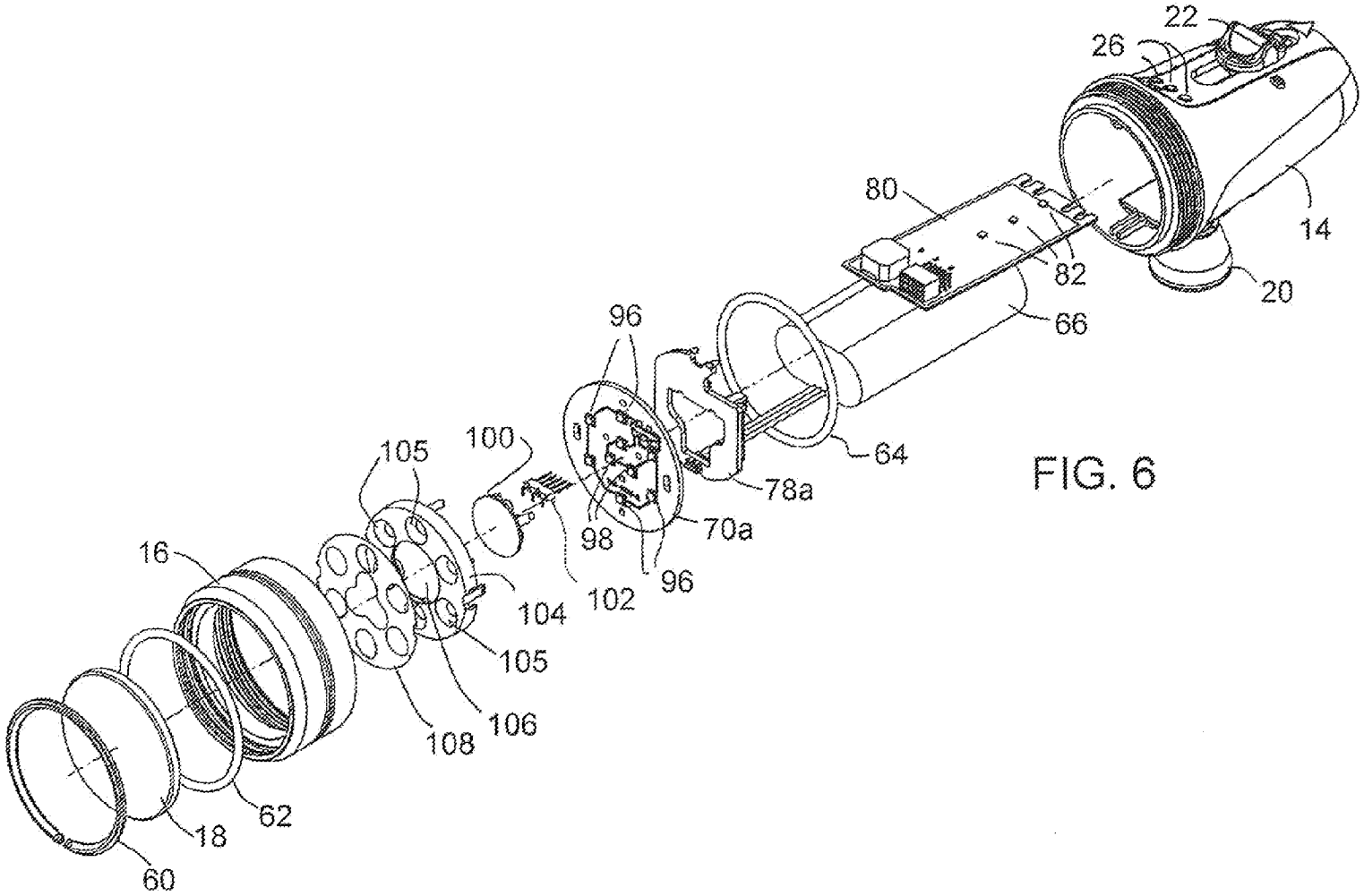
FIG. 6 is an exploded perspective view similar to FIG. 3, but showing the construction and assembly of the light device of the second embodiment.

FIG. 6 is an exploded assembly drawing very similar to that of FIG. 3, but with the flood/spot LEDs and optics rather than the red/white LEDs discussed for the earlier embodiment. In FIG. 6 the same reference numbers are used for components that are the same as those in FIG. 3.

In this form of dive light, the LED printed circuit board or LED board 70*a* is fitted into the assembly and the casing 14 in the same way as above, but the LEDs and optics are somewhat different. As noted above, an outer ring of preferably six flood LEDs 96 are mounted on the LED board 70*a*, connected in series as shown, and a tight cluster of preferably three centrally located LEDs 98 are the spot LEDs, on the same board and also connected in series but in a separate circuit from the flood LEDs. A PCB retainer is shown at 78*a*, behind the LED board 70*a*.

The focus LEDs 98 project light that is focused by a transparent mounting plate 100 having three TIR (total internal reflection) lenses that focus the LED light to spot focus. The spot angle in a preferred embodiment is between about 8° and about 17°, or slightly wider, or in one embodiment about 12°+/−1°. The TIR optic 100 is a single molded piece made from an optically clear plastic or silicone. In this particular embodiment, the single molded piece has three distinct TIR reflectors. This allows the use of three small LEDs which combine to create a 12° spot beam. A pin connector seen at 102 is soldered to the front of the LED board 70*a*, which is a metal core board with dielectric at front, and the pins extend through to connect with the LED driver printed circuit board 80.

As shown in FIG. 6, a reflector disc 104 for the flood LEDs 96 has a center opening 106 sufficiently large to accommodate the TIR lens plate 100. The reflector 104 includes essentially conical reflector recesses 105, one for each flood LED. A sticker 108 is secured over the assembled reflector 104 and TIR device 100, for decorative purposes as seen in FIG. 4.

The TIR lens, a solid piece of clear plastic, does an effective job of focusing the beam into a tighter spread in a short space. The flood reflectors 105 are shallow, and the LEDs need to be placed as close to the glass 18 as possible to get the wide beam desired—approximately 60°. A spot beam requires a deeper reflector or a TIR lens to gather the light emitted widely and to redirect it back centrally, creating a spot beam. Achieving the two types of beams from the same device is difficult and unique with this invention—LEDs close to the glass window for flood light and LEDs far back from the window as normally required for a spot beam. Although reflectors could be used to create the spot beam, TIRs tend to be smaller for doing the equivalent focusing. Since pursuant to the invention all the LEDs are mounted on the same PCB to keep costs lower and space requirements less (versus having two different PCBs positioned at different distances from the glass to allow room for a shallow and a deep reflector), the invention makes a compromise with a moderately shallow system design that allows enough depth for a reasonable spot beam (about 8° to 17°) while still allowing the flood to deliver close to 60°.

The flood reflectors are "a-focal". They are designed to spread the beam and mix it to make it clean. Instead of a typical parabolic reflector the flood reflector is simply a cone that scatters the light and thereby encourages a clean mixing of the light with no focal point, producing a nice even flood. Because the flood reflector is somewhat deeper than the depth needed for the TIRs for the spot, the a-focal cones can have a step in them, with a tighter cone close to the LED, stepping wider to essentially put the cone surface farther from the LED so it does not interfere with the escaping light.

In one preferred embodiment, the diving light 10 of the invention emits a flood light beam, at maximum power, of up to about 3000 lumens with six LEDs. For wide angle shooting videographers prefer a light level approximately in this range, or even higher; light output can continue to increase as LEDs and batteries improve. The spot beam is preferably about 1200 lumens, usually used for "macro" videography focusing on small creatures, typically shot at night. In one embodiment the spot employs two arrays of three-LED clusters in the center, surrounded by the flood LEDs around the perimeter. This arrangement allows the spot to deliver over 1000 lumens.

The weight of the unit preferably is no more than about 265 grams (0.6 pound). The flood beam angle is about 60°, while the spot angle preferably is in the range of about 8° to 17°, about 12° in a preferred embodiment. On a full battery charge the unit can produce 3000 lumen flood light for about 50 minutes, or a higher light level if desired, depending on the battery. Charge time can be about 100 minutes for a 3000 lumen flood light, but this depends on the charger. For lower selected light settings, duration will increase approximately in inverse proportion to light level.

Figure 7:
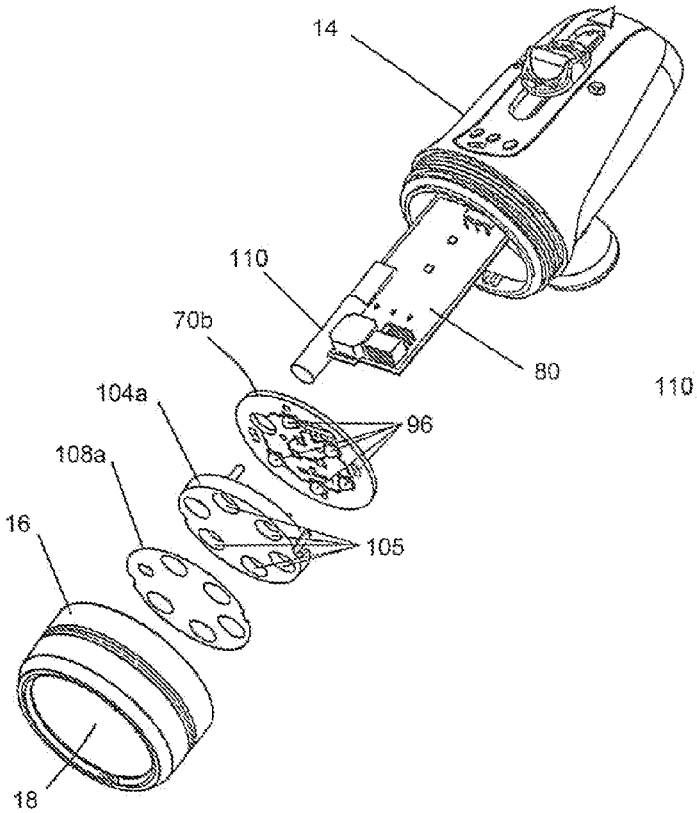
FIG. 7 is an exploded perspective view showing the addition of a laser device to the underwater light device.

FIG. 7 shows an exploded perspective view of an embodiment of the invention that includes a lasing device. In this case, one of the flood LEDs 96 has been removed from the outer ring array of six LEDs on the modified LED circuit board 70*b*, to make room for the lasing device 110 where it will fit in the compact housing. The sixth LED could be moved to the center or left off if not required for the desired lumen output (or the laser could be moved to center, as described below). On the modified reflector 104*a*, one of the reflector cones 105 has been removed to make room for the lasing device. On the modified sticker 108*a*, one of the holes has been made smaller to mask the outer portion of the lasing device cosmetically while allowing the laser beam to pass through.

The lasing device is mounted to the driver printed circuit board 80 so that it can be controlled easily by the switching mechanism previously described. The switch preferably has a momentary (spring-biased toward off) feature for the laser, for brief periods of laser beam use. In a preferred embodiment it can be used independently, whether or not another light is activated.

Figure 8:
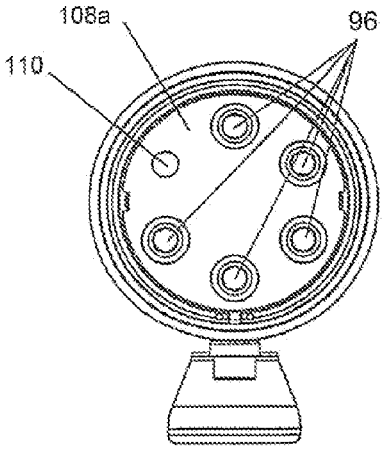
FIG. 8 is a front elevation view showing the appearance of the face of the product with a flood/laser pointer implementation.

FIG. 8 is a front elevation view. The five LEDs 96 shown provide spot or flood output, as described above. The lasing tube 110 provides the laser output, preferably a green laser beam.

Other laser output colors can be used if desired. LED output colors can also be as desired. The ability to select blue light (whether with blue-emitting LEDs or via a filter) when filming during daylight is important because it allows the videographer to match the color of light from the video lights to the color of sunlight filtered through seawater. Blue light also is useful for capturing on film an underwater creature that phosphors and can only be seen with blue light. Infrared is useful in military applications. Any desired light wavelength can be included, by inclusion of LEDs for the light color or by filtration, which can be part of the internal optics or could be an external filter. An LED array can have mixed LEDs to achieve a desired output color.

Figure 9:
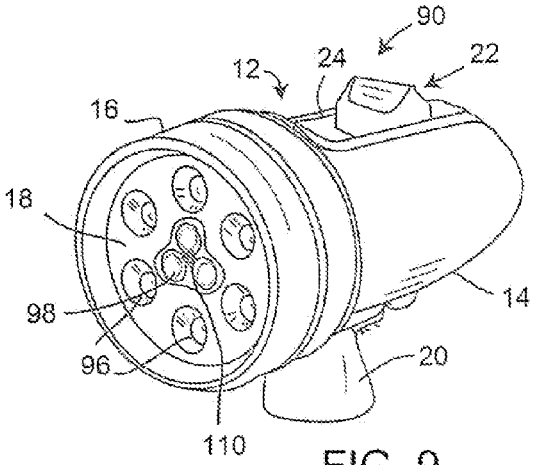
FIG. 9 is a frontal perspective view of a further embodiment of the light apparatus with a laser pointer located centrally relative to the spot beam, and with the choice of flood beam, spot beam, and/or laser pointer.
Figure 10:
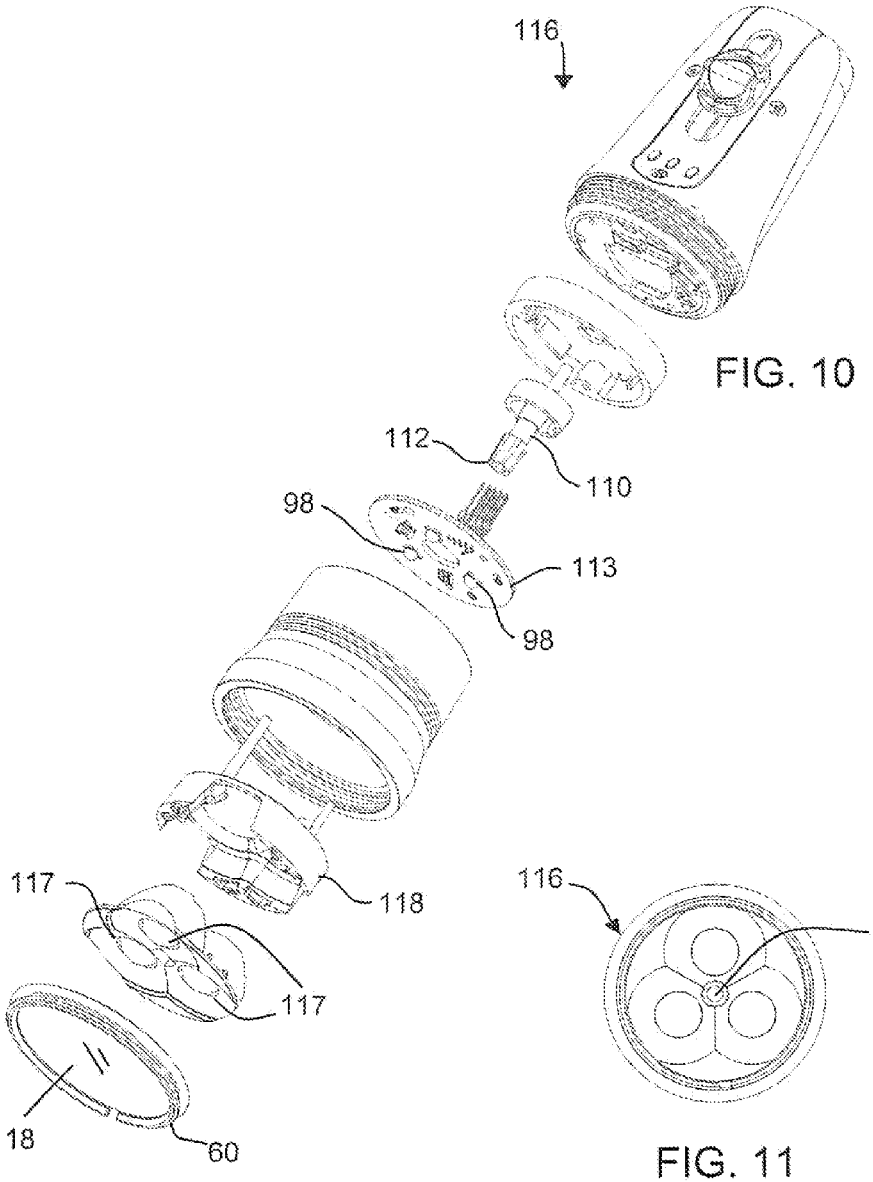
FIG. 10 is an exploded view in perspective showing an underwater light embodiment with a laser pointer located centrally with respect to the spot beam, this embodiment not specifically showing a flood beam.
Figure 11:
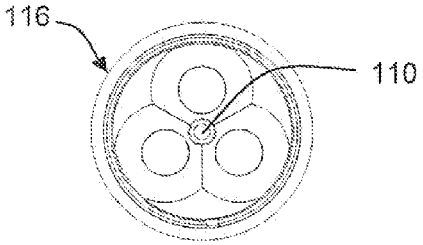
FIG. 11 is a frontal view of the device shown in FIG. 10, as assembled.

FIGS. 9, 10 and 11 show further embodiments of combination underwater lights switchable between or among flood, spot and laser pointer. FIG. 9 shows the spot/flood light in a form similar to that of FIG. 4, but with a laser pointing device shown at 110, centrally located relative to the LEDs 98, which are spot LEDs, and also central relative to the outer ring of LEDs 96, which are flood LEDs. The location of the lasing device 110, such that it will place the laser spot within the spot light beam, is preferred for the reason explained above, i.e. the spot light beam can be switched on temporarily as desired, so that the laser spot can readily be found when projected through clear water. The lasing device may have a spring-loaded momentary switch.

FIGS. 10 and 11 show the laser beam generator, including the laser tube 110 and a rubber centering boot 112 (to center the laser in an LED plate 113), but in this example the underwater light device 116 has only spot LEDs 98, with the laser beam originating from the center of the array of LEDs. For a spot/flood/laser beam embodiment such as shown in FIG. 9, the arrangement of components and electronics is similar to that shown in FIG. 6, but with the laser beam generator 110 at center as in FIG. 10. For focusing the spot LEDs 98, TIR reflectors (lenses) 117 are employed, with the depth and simplicity advantages as explained above. These TIR lenses (three for this embodiment) can be formed individually as shown, or can be incorporated in a single plastic molding. For individual lenses 117 a holder 118 is included.

It is preferred but not essential that the laser beam originate at the center of the array or arrays of LEDs. A non-centered laser beam would be sufficient, but only if it will locate the laser beam spot within the spot light beam as projected on an object or landscape within a range of distance at which the laser pointing beam will be used. Thus, the laser beam could emanate from a point precisely at center, and could be aimed to converge somewhat toward the center of the spot beam, so long as the laser spot will appear within the projected spot light beam at all distances at which the laser pointer will be used.

Figure 12:
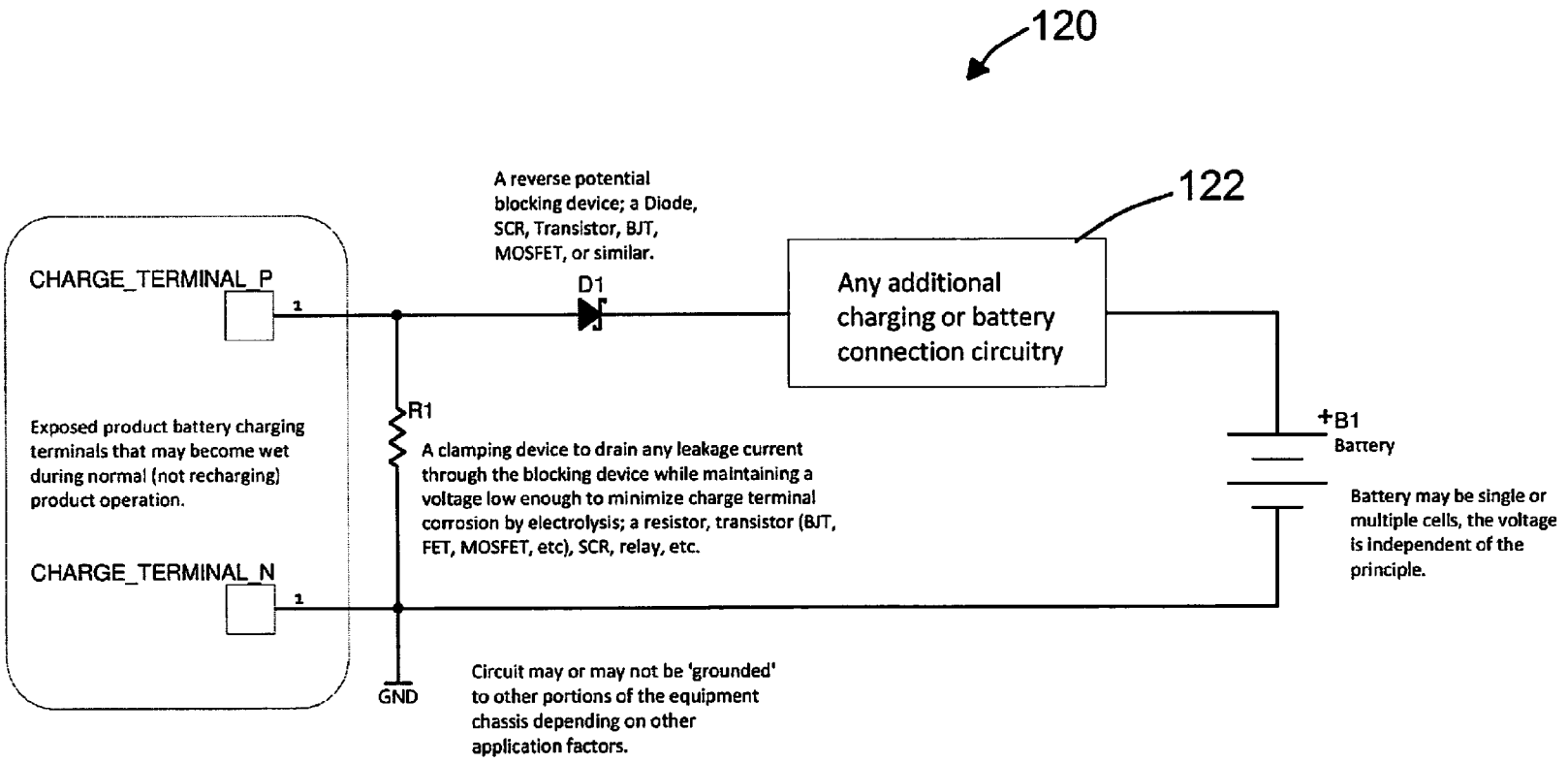
FIGS. 12, 13 and 14 are schematic diagrams showing alternative circuitry for external "wet charge" battery charging terminals, for preventing any substantial electrical potential between the positive and negative terminals when exposed to water.
Figure 13:
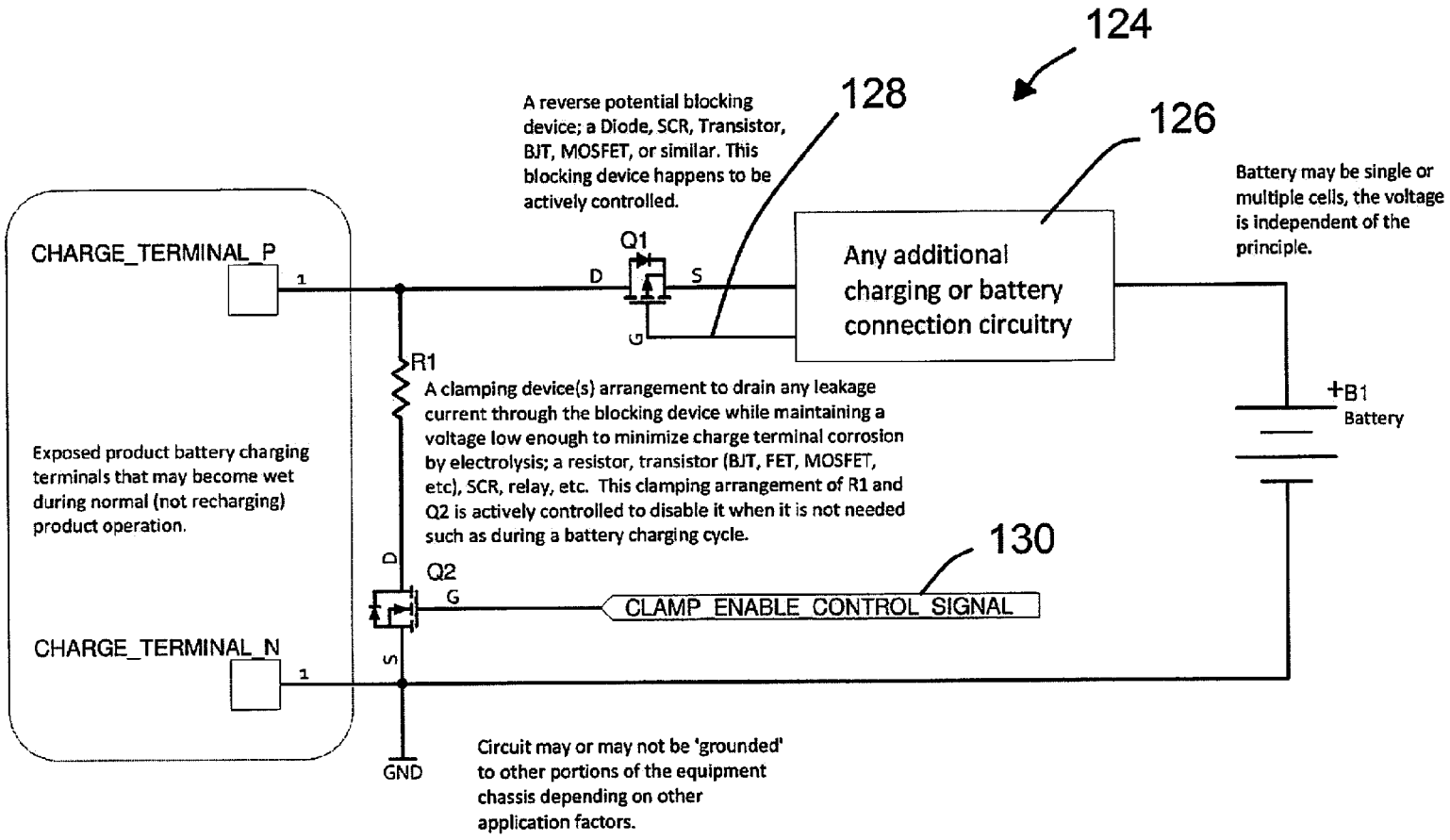
Figure 14:
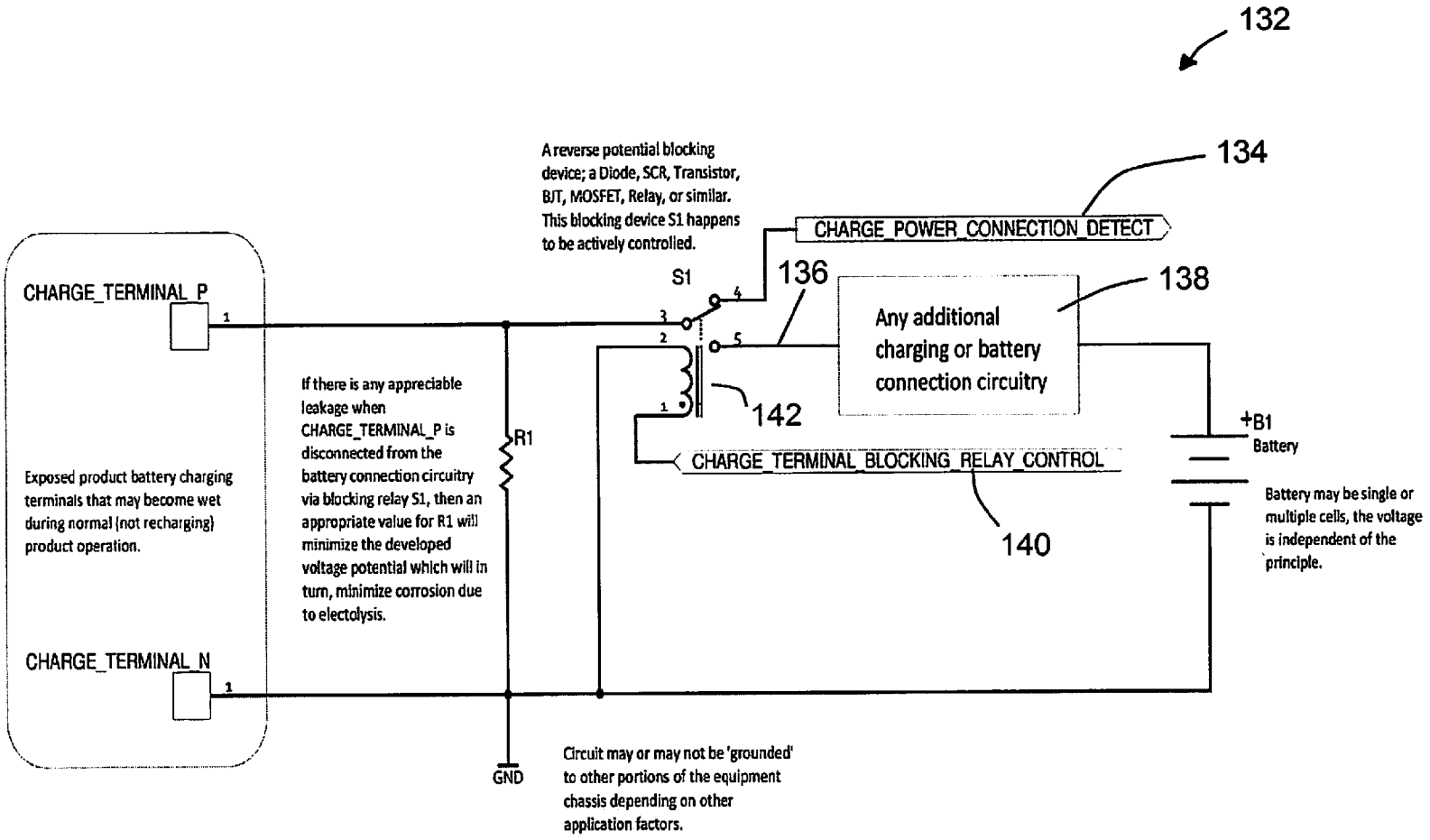

FIGS. 12, 13 and 14 show alternative circuits that can be included in the underwater light device of the invention, for isolating the battery from at least one of the charging terminals. As discussed above, the positive and negative charging terminals are at the exterior of the underwater light housing, shown, for example, at 52 and 54 in FIG. 2. These charging ports or terminals, which contact water and usually salt water, preferably are gold-plated. However, these wet-exposed charging terminals will still cause voltage potential leakage and associated corrosion by electrolysis. Almost all naturally wet environments, such as rivers, lakes, oceans, rain, etc., contain various additional minerals and elements (especially salts) that, with the water, will create a somewhat conductive, liquid wet electrolyte. Any metallic terminals with a voltage potential difference between them, in contact with the liquid, will corrode via electrolysis. Exposed terminals used for charging connect to the device's battery through some type of circuitry. This connection to the battery exacerbates the electrolysis problem.

To minimize corrosion due to electrolysis between the exposed metallic terminals, the invention uses a reverse current flow blocking device to minimize the electrical current that can flow from the product's battery to the exposed metallic terminals. Since many reverse current flow blocking devices still leak some amount of current, a conductive electrical "clamping" device is added to shunt the leakage current and minimize the development of any voltage potential difference between the exposed metallic terminals. The current flow blocking device may or may not also block current flow in the forward direction when the product's battery is not being charged, depending on the specific blocking device used. Even with the main switch off, this does not necessarily stop all forward flow. Some circuits stay awake listening for a user input even when switched off. This minor current can still create a potential across the exposed charging terminals that needs to be eliminated.

The blocking device might be used to reduce the in-rush current to protect the charge contact plating. A blocking device also can be used to prevent uncontrolled connection of an external power source for safety reasons, a device not designed to work with the light.

If the current flow blocking device has sufficiently low leakage current—such as a mechanical relay device—then no additional electrical "clamping" device may be necessary to further reduce possible voltage build-up at the exposed terminals or provide further reduction of corrosion by electrolysis.

FIGS. 12, 13 and 14 show three examples of circuitry pursuant to the invention, for preventing electrolysis between terminals P and N shown in the diagrams, these terminals being external and exposed to ambient water, and can be considered the external charging terminals 52 and 54 shown in FIG. 2.

In FIG. 12 the circuit 120 includes a reverse potential blocking device Dl which can comprise a diode, SCR, transistor, BJT, MOSFET or similar blocking device. The battery is shown at B1. Additional charging or battery connection circuitry is indicated in a block 122. This indicates voltage regulation and other controls that are needed in charging circuits. Previously, many battery charging arrangements have had such charging control circuitry not internal to the light housing, but external, as part of a plug-in transformer unit, such as for use with 110-volt wall current, but which could also be a car charger receiving 12 volts.

Also shown in FIG. 12 is a "clamping" device indicated at R1, which is effective to drain any leakage current through the blocking device Dl while maintaining a voltage low enough to minimize corrosion of the charging terminals by electrolysis. R1 can be a resistor, a transistor (BJT, FET, MOSFET, etc.), SCR, relay or other device. R1 is controlled in such a way as not to provide any significant conductive path so as to "short" during the charging process when a charger is connected to the terminals P and N.

FIG. 13 shows a circuit 124 somewhat similar to that of FIG. 12, but with actively controlled components. At Q1 is a reverse potential blocking device, which again can be a diode, SCR, transistor, BJT, MOSFET, or similar. In this case the device Q1 is actively controlled so as to change status when a charge cycle begins. As indicated, charging or battery connection circuitry 126, which includes logic, is connected in the charging circuit and determines when a charger has been connected (and also determines when the battery is fully charged, along with other typical functions). A control line is indicated at 128, effective to fully close the circuit between points D and S, bypassing the Q1 diode or other device. When the charger is not present, D and S will again be connected only through the diode or other device.

Again, a clamping device is shown at R1 and Q2, in a connection extending between the P and N terminals. This clamping arrangement of R1 and Q2 is actively controlled, so that it is disabled when not needed, i.e. during a battery charging cycle. The drawing indicates a clamp enable control signal at 130. The signal is sent by logic connected in the circuit which detects the commencement of a battery charging cycle as noted above. When a cycle begins, the control signal 130 is effective to open the circuit between S and D (adjacent to $Q_2$) so that clamping is deactivated. When charging is discontinued, a signal 130 to Q2 closes the path between S and D, so as to provide clamping to prevent potential leakage between the exterior contacts P and N.

FIG. 14 shows another embodiment of a reverse potential blocking circuit 132. The circuit is actively controlled, including a form of switch at S1, so that the charge terminal P is connected either to charge power connection detect circuit A and logic 134 or to a line 136 leading to the battery B1. Again, a charger control circuitry and/or logic is included within the housing and in the circuit, indicated at 138. When a charger is connected at the terminals P and N, the system logic via detection 134 sends a signal indicated at 140 to operate a relay 142, which will change the position of S1 to connect the terminal P to the line 136 so that the battery can be charged. When charging is removed, S1 moves back to the position shown in the drawing, which can be via a signal from the logic block 138. Thus, when the battery is not being charged, the terminals P and N are not both connected to the battery. However, there can remain some small potential due to the connection detect circuit being active and connected to the battery, depending on implementation. For this case a "clamping" device can be used, as shown at R1 as discussed below.

The clamping device at R1 is similar to that of the circuit of FIG. 12. This is optional. If there is any appreciable leakage when charge terminal P is disconnected from the battery connection circuitry via the blocking relay 142, 51, then an appropriate value for R1 will minimize the developed voltage potential, which will minimize corrosion of the terminals due to electrolysis.

It is also possible to disconnect one or both of the charge terminals P and N by a mechanical or magnetic device. For example, the charging device when attached to the exterior of the housing can be configured to push inward on a sealed flexible wall section or membrane, which is effective inside the housing to effect closure of a switch that connects the charger to the battery. A magnetic device can be similar to the main switch described above; a magnet in the charger plug or implement that engages against the housing is sensed by a component just inside the housing, causing closure of a switch to connect the charging circuitry. When the charger is removed, the internal circuit is opened, so that the P and N terminals are not both connected to the battery.

Figure 15:
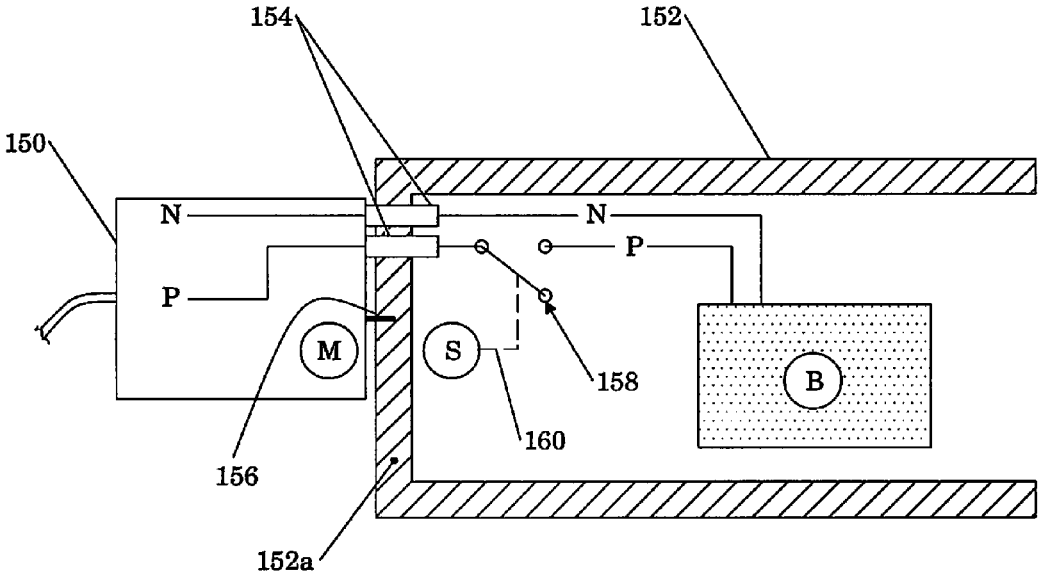
FIG. 15 is a schematic elevation view in section showing a magnet-operated control device for shunting the battery charging circuit from the wet charge exterior contacts from the battery.

FIG. 15 is a simple schematic drawing indicating an example of a magnet-activated embodiment of charging port shunt system. A charger coupling or plug is indicated at 150, engaged against the back of a light housing 152. The charging ports, i.e. contacts, are indicated at 154 and can be sockets as described above or a simple flat contact or even a convex metal bump on the outside of the housing 152. The coupling or plug 150 is engaged and held against the back of the housing by a suitable form of latching connection. A simple non-electrical prong 156 is shown in the drawing, engaged in a socket of the housing with sufficient friction to hold the charging plug 150 in place. More than one can be included. Alternatively, the latch could be one or more deformable hooks that snap over a ridge. The charging plug has spring-loaded contacts (not shown) that engage against the charging port contacts 154 on the housing. Charging is conducted above water.

Inside the housing are indicated positive and negative wiring leads P and N, leading from the contacts 154. One of these, shown as the P wire, is indicated as having a switch 158 that is either open or closed, thus either to disconnect the positive charging port contact 154 from the battery or to connect it to the battery. A magnet M is indicated inside the charging plug 150. A sensor S inside the housing and adjacent to the exterior wall 152*a* of the housing senses the presence of the magnetic field from the magnet M and, when that occurs, closes the switch 158. Switch actuation is indicated by the dashed line at 160. When the charging coupling 150 is removed, thus removing the magnetic field, the sensor S no longer closes the switch, and the switch is opened by a spring (not shown), which returns the switch to the normally open position.

As noted above, external battery charging ports 52, 54 (FIG. 2), also indicated as P and N (FIGS. 12-14) can be essentially flat or flush spots (or even short bumps) on the housing, rather than sockets that receive pins. Such contacts are included in the meaning of "port" or "terminal". The charger plug or coupling can be a device that engages securely with the exterior of the housing (with a snap-on device or clip), with spring-loaded contacts to engage against the light housing terminals. This contact configuration is better for avoiding terminal corrosion.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. An underwater light for divers, comprising:

a waterproof housing, a plurality of LEDs mounted in the housing for projection out a front of the housing, including flood LEDs and spot LEDs, driver circuitry in the housing for the flood LEDs and the spot LEDs, arranged to drive the flood LEDs and spot LEDs separately, optics positioned in front of the LEDs to direct light from the flood LEDs as flood light and from the spot LEDs as spot light, a window at the front of the housing through which selected flood or spot LED light can be projected in a forward direction, a power source, a switch on the exterior of the housing, operatively connected to switch on power from the power source to the LEDs and to selectively power the flood LEDs or the spot LEDs, and wherein the switch comprises a slide switch with an exterior manually operated slide member positioned on the exterior of the housing for sliding movement on a switch cover, the slide member being spring-biased toward a rest position, and the housing being water sealed below and independently of the slide member and switch cover, with a magnet connected to the slide member, and the switch including, in an internal sealed space in the housing, magnetic pickups in the circuitry to detect movement of the magnet and to effect power on, power off and selections between flood and spot light.

2. The underwater light of claim 1, including in the housing a printed circuit board with LED drivers and the magnetic pickups.

3. The underwater light of claim 1, wherein the slide switch includes a lockout feature engaged by rotating the manually operated slide member 90° when in the rest position, the lockout feature being effective to prevent unintended switching of the underwater light.

4. The underwater light of claim 1, wherein the switch includes selection among multiple light power levels.

5. The underwater light of claim 1, wherein the optics include a series of conical reflector holes positioned to be in front of and in the path of light from the LEDS.

6. The underwater light of claim 5, further including indicator lights on the exterior of the housing, indicating power level of the white light.

7. The underwater light of claim 6, wherein the housing comprises a casing and a front cover comprising a bezel retaining a window, the bezel having screw threads for securing to the casing via threads on the casing.

8. The underwater light of claim 1, wherein the flood LEDs have optics producing a divergence angle of about 60°.

9. The underwater light of claim 1, wherein the spot LEDs have optics producing a divergence angle of about 8° to 17°, and wherein the spot and flood LEDs are mounted on a single printed circuit board, the spot LEDs being focused by TIR (total internal reflection) lenses whereby both spot and flood LEDs are positioned close to the window at the front of the housing.

10. The underwater light of claim 1, further including a laser in the housing positioned to project a visible laser beam within the spot light beam so that the laser produces a laser light spot on an object or field of objects within the position of projected light from the spot light beam.

11. The underwater light of claim 10, wherein the laser is positioned in the middle of a cluster of said spot LEDs in the housing.

12. The underwater light of claim 1, wherein the housing includes external positive and negative battery charging contacts for receiving a charging device, and further including a shunt circuit within the housing for disconnecting at least one of the external positive and negative charging contacts from the battery except when the battery is being charged, thereby to minimize or prevent corrosion due to electrolysis between the two external contacts.

13. The underwater light of claim 12, wherein the shunt circuit includes a clamping device connected between the positive and negative charging contacts.

14. The underwater light of claim 12, wherein the shunt circuit includes an actively controlled reverse potential blocking device.

15. The underwater light of claim 14, wherein the reverse potential blocking device comprises any of the following: diode, SCR, transistor, BJT, MOSFET.

16. The underwater light of claim 15, wherein the shunt circuit further includes a clamping device connected between the positive and negative charging contacts.

17. An underwater light for divers, comprising:

a waterproof housing, a plurality of LEDs mounted in the housing for projection out a front of the housing, including at least spot LEDs, driver circuitry in the housing for the LEDs, optics positioned in front of the LEDs to direct light from the spot LEDs as a spot light beam, a window at the front of the housing through which the spot light beam can be projected in a forward direction, a laser in the housing positioned to project a visible laser beam within the spot light beam so that the laser produces a laser light spot on an object or field of objects within the position of projected light from the spot beam, a power source, and at least one switch on the exterior of the housing, operatively connected to switch on power from the power source selectively to the spot LEDs or the laser or both.

18. The underwater light of claim 17, wherein the laser is positioned in the middle of a cluster of said spot LEDs in the housing.

19. The underwater light of claim 17, wherein the spot LEDs are mounted on a printed circuit board and focused by TIR lenses in front of the LEDs, so that little depth is required for focusing the spot LEDs, the LEDs being positioned close to the window.

20. The underwater light of claim 17, wherein the housing includes external positive and negative battery charging contacts for receiving a charging device, and further including a shunt circuit within the housing for disconnecting at least one of the external positive and negative charging contacts from the battery except when the battery is being charged, thereby to minimize or prevent corrosion due to electrolysis between the two external contacts.

* * * * *